US005127769A

United States Patent [19]

Tadolini et al.

[11] Patent Number: 5,127,769

[45] Date of Patent: Jul. 7, 1992

[54] THRUST BOLTING: ROOF BOLT SUPPORT APPARATUS

[75] Inventors: Stephen C. Tadolini, Lakewood; Dennis R. Dolinar, Golden, both of Colo.

[73] Assignee: The United States of America as represented by the Secretary of the Interior, Washington, D.C.

[21] Appl. No.: 734,002

[22] Filed: Jul. 22, 1991

[51] Int. Cl.[5] ..... E21D 20/02

[52] U.S. Cl. ..... 405/259.5; 405/288; 405/259.6

[58] Field of Search ..... 405/259, 260, 261, 262, 405/288, 290; 299/11

[56] References Cited

U.S. PATENT DOCUMENTS

| | | | |
|---|---|---|---|
| 2,525,198 | 10/1950 | Beijl . | |
| 3,108,443 | 10/1963 | Schuermann et al. . | |
| 3,303,736 | 2/1967 | Raynovich, Jr. . | |
| 3,877,235 | 4/1975 | Hill . | |
| 3,892,101 | 7/1975 | Gruber . | |
| 3,925,996 | 12/1975 | Wiggill . | |
| 3,940,941 | 3/1976 | Libert et al. . | |
| 3,942,329 | 3/1976 | Babcock | 405/260 |
| 3,971,226 | 7/1976 | Morrell | 405/288 |
| 3,979,918 | 9/1976 | Vidler . | |
| 4,023,373 | 5/1977 | Hipkins . | |
| 4,051,683 | 10/1977 | Koval . | |
| 4,079,592 | 3/1978 | Eakin | 405/260 |
| 4,127,000 | 11/1978 | Montgomery, Jr. et al. . | |
| 4,129,007 | 12/1978 | Rausch . | |
| 4,216,180 | 8/1980 | Seeman et al. . | |
| 4,275,975 | 6/1981 | Morgan . | |
| 4,413,930 | 11/1983 | Calandra, Jr. . | |
| 4,419,805 | 12/1983 | Calandra, Jr. . | |
| 4,501,515 | 2/1985 | Scott | 405/259 |
| 4,511,289 | 4/1985 | Herron . | |
| 4,898,505 | 2/1990 | Froelich . | |

*Primary Examiner*—David H. Corbin
*Attorney, Agent, or Firm*—E. Philip Koltos

[57] ABSTRACT

A method of installing a tensioned roof bolt in a borehole of a rock formation without the aid of a mechanical anchoring device or threaded tensioning threads by applying thrust to the bolt (19) as the bonding material (7') is curing to compress the strata (3) surrounding the borehole (1), and then relieving the thrust when the bonding material (7') has cured.

4 Claims, 1 Drawing Sheet

THRUST BOLTING: ROOF BOLT SUPPORT APPARATUS

TECHNICAL FIELD

This invention relates to a method for installing a roof bolt in a borehole of a rock formation and more specifically to tensioning the unit without the aid of a mechanical anchoring device or threaded tensioning threads. The bolt is capable of being placed into tension along the length and the levels of active support can be controlled by varying the length of the grouted portion and the level of thrust applied to the bolt during installation.

BACKGROUND OF THE INVENTION

It is a well established fact that to reinforce and stabilize underground rock formations, such as a coal mine roof, an underground tunnel, or any subterranean structure, the application of roof bolts, inserted into boreholes drilled into the rock formation, is the recommended standard practice and often is required by Federal law. The bolts fall into three generalized categories i.e. 1) passive support, 2) active support, and 3) frictional supports.

Passive supports involve installing the grout or resin anchoring systems into the borehole ahead of the reinforcing rod. This can be accomplished by inserting the material into cartridges that are ruptured as the end of the rod is forced and usually rotated at the same time through the cartridge. The material fills the annulus along the borehole wall, cures with time, and then uses a mechanical interlock mechanism for anchoring the rod unit. Another option for passive support system is to place the rod into the borehole and pump the pressurized anchoring material into the borehole along the rod or through the center of the rod. Passive support systems are loaded by allowing the immediate roof to deflect downward, thus placing the rod into tension.

Active support systems can be placed into the borehole with a threaded end that accommodates a mechanical expansion shell. Rotation of the bolt advances the calming plug downward relative to the shell to expand the fingers on the plug into a gripping engagement along the borehole wall. By continuing to rotate the bolt, higher levels of tension are generated along the roof bolt axis. Another method for creating active support systems was to install the rod in a similar fashion to passive supports. When the anchoring material has cured the bolt was placed into tension by turning a nut on the bottom end the desired level of tension has been obtained. The levels of tension are usually determined with a torque wrench.

Frictional supports are placed into a borehole by applying force at the end of the bolt to deform the unit as it is pushed into the hole or by expanding the bolt with compressed water after it is placed into the borehole (U.S. Pat. No. 4,511,289). Both of these systems rely on the friction generated between the bolt and the borehole wall to resist movement as load is applied via the bearing plate.

U.S. Pat. Nos. 3,108,443; 3,892,101; 3,940,941; 3,979,918; 4,051,683; 4,127,000; 4,129,007; describe systems that use a grout or resin to anchor a roof bolt into a rock formation. U.S. Pat. Nos. 3,925,996 and 4,216,180 describe multi-component resin systems in which the resin mixture cures and hardens within seconds after a thorough mixing.

U.S. Pat. Nos. 3,877,235; 4,051,683; 4,023,373 ; and 4,275,975 disclose chemically anchored roof bolt systems that include an anchor portion which is inserted into the borehole behind the resin cartridges and a lower portion which is connected to the anchor portion. With these types of support systems, once the resin has been adequately mixed and cured to adhesively secure the anchor portion in the borehole, torque is applied below the anchor portion by rotating the bolt relative to the anchor. This draws the roof plate on the end of the bolt in relative to the rock formation. In this manner the bolt is put into tension.

Recent U.S. Pat. Nos. 4,413,930 and 4,419,805 disclose methods and apparatus for combining resin bonding characteristics with mechanical anchoring of the bolt in the rock horizon. With these devices a single bolt with a mechanical anchor positioned along the upper threaded end of the bolt is inserted into a borehole behind a tube or tubes of resin or cement cartridges. The roof bearing plate is carried on the opposite end of the rock bolt to accept and apply loads against the rock formation surrounding the open end of the borehole. The cartridge system is ruptured by simultaneously pushing and rotating the bolt to release and mix the cartridge components, normally resin, a stop device, or other means associated with traditional expansion anchor designs, restrains expansion of the shell when the bolt is rotated in the selected direction to mix the resin components. Rotation of the bolt continues until the resin has been thoroughly mixed according to the manufacturers recommendations. As the resin mixture begins to harden, the shell expands into the engagement position with the borehole wall and further rotation of the bolt exerts a tension component into the bolt. The tension component extends from the base of the anchor to the head of the bolt.

Rock strata and rock formations above underground openings can include homogenous materials as well as bedded formations. Bedded formations can include a variety of sedimentary materials such as shale, mudstone, coal, claystone, and other types of rock formation. These layers can vary in thickness and occur in random orders that deviate from horizontal bedding planes. While certain layers, such as sandstone, can have high strength characteristics, they may also occur in very thin beds that would prevent proper support utilizing only expansion anchor support systems. With this type of roof it becomes necessary, in the past, to drill boreholes through the strata until a stable horizon could be located to permit the proper anchorage of the bolt expansion shell. This may require inordinately long holes or in several no stable horizon could be located. Even if a stable horizon can be located, the anchor placed into tension by subsequently tightening the bolt can fail because of anchor slippage, relaxation, and a deterioration of the material underneath the bearing plate. This type of unit with the subsequent post-installation behavior, without being placed into and maintaining tension, would be analogous to installing no support and create hazardous conditions.

In an effort to maintain a larger contact area between the expanded shell member with soft rock strata, special multiple anchors positioned in tandem on a bolt have been developed and disclosed in U.S. Pat. No. 3,469,407.

U.S. Pat. No. 2,525,198 discloses an anchor bolt that includes an upper threaded bolt and a tubular member of a preselected length. A lower expansion anchor shell assembly is positioned on the lower threaded bolt. With this arrangement the contact area between the bolt and the borehole wall is expanded. Bolt tension in this unit is still generated using a mechanical method. U.S. Pat. No. 3,303,736 discloses an expansion shell assembly adapted for positioning anywhere on the threaded potion of the bolt.

While it has been suggested by the prior art, devices that utilize mechanical anchors or a combination of mechanical and chemical anchors to secure a bolt in a borehole, to overcome problems associated with obtaining adequate anchorage to place a bolt in tension, are severely limited. These limitations include: the development of adequate anchorage to accept and maintain high tension loads, methods to minimize and eliminate bolt load tension installation losses due to the friction between the bearing plate and the head of the bolt, methods to minimize or eliminate friction between the threaded portion of the bolt and the expansion portions, and a method to install and maintain predetermined tension loads using only the properties of the bolt installation procedure. These factors all influence the final installation tension, which greatly affects the overall stability of the subterranean excavation.

SUMMARY OF THE INVENTION

In accordance with the present invention, there is provided a method to install a traditional headed rebar bolt, with an adequate bearing plate, into a borehole behind a cartridge of resin or cement grout. The bolt is rotated and pushed into the borehole perforating the cartridge and ensuring adequate mixing. After the anchorage material has been adequately mixed, the bolt is thrust upward against the rock formation with large forces, moving the immediate roof into a compressive position. The roof bolt rod is held in this position until the anchorage material, resin or grout, has adequately cured. This cured material forms the basis for the anchorage along the borehole walls. The bolt is locked into place by developing mechanical interlock positions between the bolt, the bonding material, and the borehole wall. When the active force is released the roof will try to move back into its normal position, prior to the application of the active thrust force. Any downward movement by the roof will place the bolt rod into a state of tension. This state of tension can be varied and controlled by increasing or decreasing the final length of the resin column or by varying the amount of initial upward thrust applied to the bolt during installation. No mechanical components are required to develop tension, eliminating all of the variables associated with friction parameters. The amount of force or tension developed on the bolt is carried along the entire axis of the bolt and is not limited to concentrated areas. This eliminates stress concentrations and provides for the development of a uniform anchorage along the entire grouted length. This reduces the characteristics of bolt tension "bleed-off" and provides adequate anchorage across weakened zones of the roof strata.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
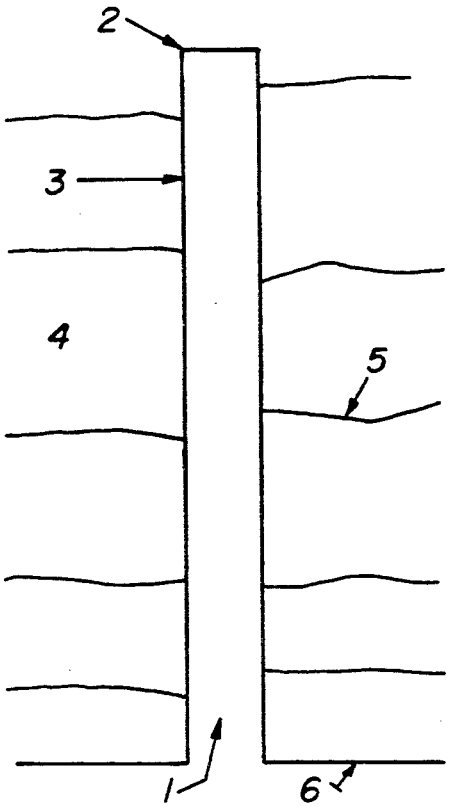
FIG. 1 is a cross-sectional view taken through a bore hole in a mine roof.

FIG. 1 is a cross-sectional representation of the strata after the borehole 1 has been drilled to the proper depth to assure adequate anchorage. This depth is represented by the reference number 2 is predetermined before the final length of the bolt is selected and always must be at least 1-inch deeper than the rod that is going to be placed into the borehole. Reference number 3, pointing to the borehole wall indicates that the tolerance on the borehole wall is maintained to approximately 0.125 – 0.250 inches larger than the diameter of the rod. This ensures adequate mixing and cohesion of the bonding material. The material along the borehole can vary from layer-to-layer, as it usually occurs in a sedimentary environment, or it can be homogeneous as indicated by reference numeral 4. Reference numeral indicates that bedding separations or transition zones in geology can be present, varying according to the geologic horizon. These cracks or separations may open as the in situ rock mass is relieved by excavating the opening. Reference numeral 6 shows the position of the unstressed roof just after drilling the borehole and prior to installing a roof bolt.

Figure 2:
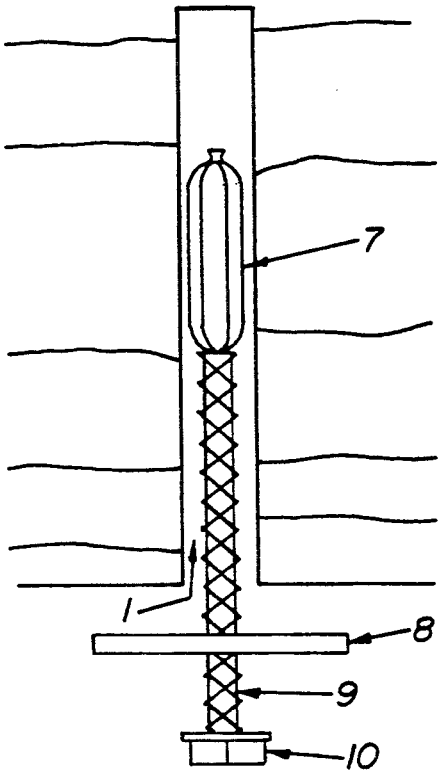
FIG. 2 is a view similar to FIG. 1 showing the bolt being inserted into the borehole.

FIG. 2 is the same cross hole representation with a roof bolt (9) being introduced into the borehole; and having a capsule of resin grout or cement grout (7) that has been previously selected for anchoring the bolt (9) preceding the bolt (9) into the borehole in the conventional manner. In addition a roof bolt bearing plate (8) is operatively secured to the headed traditional rebar bolt (9) at a location disposed proximate to, but spaced from the forged head (10) of the rebar bolt (9).

Figure 3:
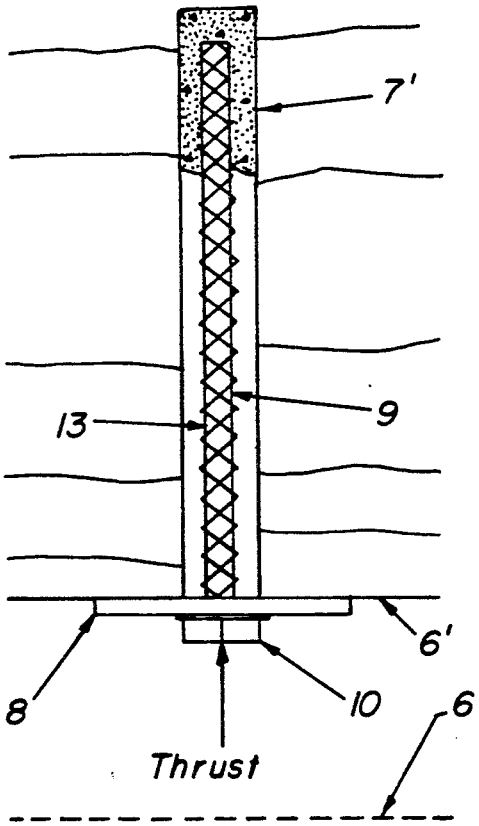
FIG. 3 is a view similar to FIG. 2, showing the ruptured capsule surrounding the bolt and bore; and, FIG. 4 is a view similar to FIG. 3, showing the tensioned bolt surrounded by the cured grout.

FIG. 3 shows the final representation of the bolt (9) placed into the borehole and penetrating the resin or grout cartridge(7). The is spun the required time, to ensure adequate mixing and bonding. The anchorage material (7') will be disposed at the top of the borehole or the full length of the bolt; wherein, the anchorage length is determined by the type of anchorage required for the installation and subsequent loading parameters. FIG. 3 also shows the final position of the resin or cement material (7') after pushing the bolt (9) into the borehole and rotation; wherein the ribs (13) on the bolting surface are available for forming the mechanical interlock in the grouted portion of the bolt. Furthermore the roof bolt bearing plate (8) is shown being held firmly against the compressed roof (6') or side of the underground opening; when thrust is being applied through the axis of the bolt head (10). As the thrust is applied to the head of the bolt, the bolt is forced upward along with the original unstressed roof line (6); to the position indicated by (6').

Figure 4:
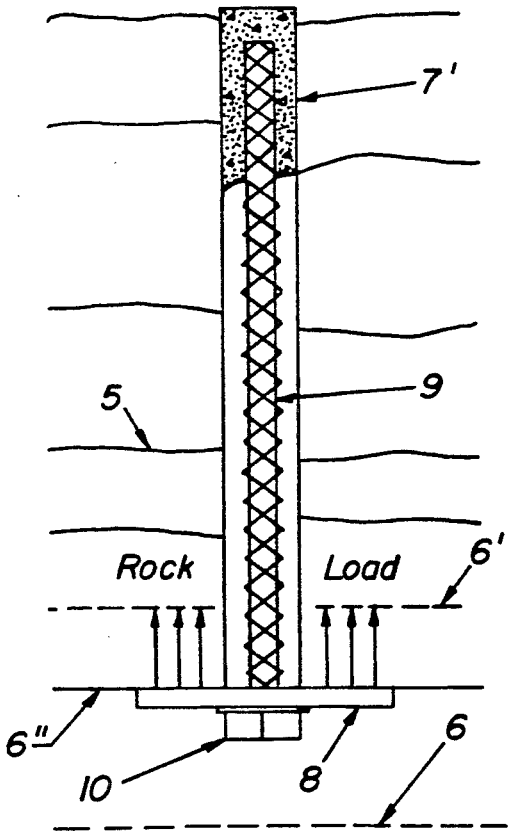

FIG. 4 shows a cross-section of the bolting system after the anchorage material has cured and the thrust is removed from the head of the bolting system. The resin or grout has now cured and has formed a mechanical interlock with the rebar and the borehole wall. This is adequate to ensure that no movement or creep occurs when the load is reapplied to the bolting system. The rebar bolt (9) is now in tension from the top of the bolt to the head of the bolt. This tension occurs along the entire length of the bolt but dissipates as it is transferred into the rock mass through the grout/resin interface. When the tensioned bolt is installed in the borehole, any cracks, separations, or partings (50) are closed and the rock is deformed elastically by the applied forces. When the load is removed these cracks and partings try to reopen but are met with the resistance created between the roof bolt bearing plate (8) and the anchorage material (7'). The load developed along the length of the bolt is transferred into the rock mass above the surface of the bearing plate as indicated by the plurality of arrows. Reference numeral (6'') represents the position of the roof after the thrust was applied to the head of the bolt. The head of the rebar bolt, is placed into tension and maintains the load established between the grouted portion of the bolt and the bearing plate as the cracks try to reopen along with the elastic rebound of the rock. The difference in elevation between the final roof line (6'') and the compressed roof line (6') is the roof horizon movement which develops the tension, No mechanical anchors, threaded bars, or threaded nuts are required.

The amount of final load on the support system can be varied by the amount of thrust applied to the head of the bolt during installation or by varying the column length of the grout or cement. The applied thrust, coupled with the known stiffness of the rock and the stiffness of the bolt, can determine the amount of force on the bolt and subsequently on the rock. The final equation is in the form:

$$F_b = \frac{K_b \times F_o}{K_r \times K_b}$$

where:

$K_b$ — stiffness of the support, psi $F_o$ — applied thrust, 1b $K_r$ — stiffness of the rock, psi, and $F_b$ — force on the bolt and rock, lb.

In the case that requires a partial column examination, the formulae that apply to spring constants can be utilized to determine resulting stiffness. Typical bolting force values for a 0.75-inch diameter 6-ft long fully grouted bolt would be:

| Applied Thrust | Bolt Load |
|---|---|
| 5000 lb | 4551 lb |
| 6000 lb | 5461 lb |
| 7000 lb | 6371 lb |
| 8000 lb | 7281 lb |
| 9000 lb | 8192 lb |
| 10000 lb | 9102 lb |

By using this "thrust bolting" technique, the amount of final load developed on an underground support system can be controlled by the amount of force applied on the head of the bolt during installation and by varying the stiffness of the support system by reducing or increasing the bonding length of the resin grout or cement.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

WE CLAIM:

1. A method for installing a headed bolt in a borehole formed in a mine surface to create tension along the entire axial length of the bolt; wherein, the method comprises the steps of:

a) inserting a conventional uncured bonding material into the borehole b) equipping the bolt with a bearing plate and inserting the bolt into the borehole to contact the uncured bonding material c) applying thrust to the head of the bolt to bring the inner end of the bolt into compressive engagement with the uncured grouting material and the strata surrounding the terminus of the bore hole; wherein, the bearing plate is also brought into compressive engagement with the strata surrounding the bore hole opening to depress the original mine surface surrounding the borehole d) maintaining the thrust from the head of the bolt until the bonding material has cured; and, e) removing the thrust from the head of the bolt to allow the depressed mine surface to attempt to return to the original mine surface and thereby create tension along the axial length of the bolt.

2. The method as in claim 1 further comprising the step of:

f) selecting the amount of tension created along the bolt by applying a selected amount of thrust in step c).

3. The method of claim 1; further comprising the step of:

g) selecting the amount of tension created along the bolt by choosing the ratio of the bonding material coated portion of the bolt relative to the uncoated portion of the bolt in step a).

4. The method of claim 1; further comprising the step of h) predetermining the amount of tension created along the bolt by choosing the amount of bonding material applied in step a) and the amount of thrust applied in step c).

* * * * *